US009309736B2

(12) United States Patent
Watson

(10) Patent No.: US 9,309,736 B2
(45) Date of Patent: Apr. 12, 2016

(54) AXIALLY SEPARATING DRILL BUCKET

(71) Applicant: Richard W. Watson, Lakeside, CA (US)

(72) Inventor: Richard W. Watson, Lakeside, CA (US)

( * ) Notice: Subject to any disclaimer, the term of this patent is extended or adjusted under 35 U.S.C. 154(b) by 510 days.

(21) Appl. No.: 13/845,556

(22) Filed: Mar. 18, 2013

(65) Prior Publication Data

US 2014/0262522 A1 Sep. 18, 2014

(51) Int. Cl.

| | |
|---|---|
| ***E21B 27/04*** | (2006.01) |
| ***E21B 27/00*** | (2006.01) |
| *E21B 7/00* | (2006.01) |
| *E21B 10/32* | (2006.01) |

(52) U.S. Cl.

CPC ..... *E21B 27/00* (2013.01); *E21B 7/003* (2013.01); *E21B 10/325* (2013.01)

(58) Field of Classification Search

CPC ..... E21B 27/00; E21B 27/04; E21B 7/003; E21B 10/325

See application file for complete search history.

(56) References Cited

U.S. PATENT DOCUMENTS

| | | | | |
|---|---|---|---|---|
| 1,442,984 | A * | 1/1923 | Smith | E21B 7/003 175/316 |
| 2,873,950 | A * | 2/1959 | Kandle | E21B 4/18 173/141 |
| 2,997,797 | A * | 8/1961 | Frankum, III | E21B 27/00 175/203 |
| 6,533,048 | B2 * | 3/2003 | Groce, Jr. | E21B 7/003 175/316 |
| 6,655,476 | B2 * | 12/2003 | Groce, Jr. | E21B 7/003 175/316 |
| 8,615,906 | B2 * | 12/2013 | Matthias | E21B 27/00 175/316 |

* cited by examiner

*Primary Examiner* — Nicole Coy
(74) *Attorney, Agent, or Firm* — Richard D. Clarke

(57) ABSTRACT

The current application provides an Axially Separating Drill Bucket for drilling large holes in the earth by which a drilling operator can perform the drilling operation with the Axially Separating Drill Bucket and remove the excavated material in one operation. The unit can be raised to the surface where the bucket portion is separated from the drill head to empty the excavated material.

24 Claims, 8 Drawing Sheets

AXIALLY SEPARATING DRILL BUCKET

FIELD OF THE INVENTION

This application relates to the field of equipment used in drilling large foundation holes for buildings and bridges and more specifically to a unique axially separating drilling bucket mechanism. The current invention provides a drilling bucket assembly along with a drill head apparatus that improves the operation by which a drilling operator can remove dirt from a drilling device. With the combination of a drilling head and bucket, the unit can be raised to the surface where the bucket portion is moved up or down from the drill head to empty the excavated material.

BACKGROUND OF THE INVENTION

Foundation drilling has evolved over time and continues to be an essential operation for all construction of bridges, buildings, and skyscrapers. Without proper holes for the drilled foundation piles, a building or bridge could be destroyed in the event of an earthquake. In an effort to improve the production and quality of drilled foundations, there has been huge investment, and advancement, in the equipment and tools of the trade.

Some of the most common tools used by foundation drillers are the separate digging, and cleanout buckets. Digging buckets are used to dig through hard layers of dirt and rock and are known for their ability in keeping fluid within the hole as clean as possible and to keep holes true and straight as possible. Augers are used for digging large holes but have no efficient means of moving wet material to the surface. Cleanout buckets are used to clean the bottom of the holes during the digging process to remove any loose rocks and soil to ensure a clean solid bottom surface for a foundation.

In executing pile foundations in construction work, a unique method of drilling earth is proposed in this application. In this method a rotatable bucket is used for excavating a straight pile bore and also moving the excavated soil from the bore hole to the surface. The Axially Separating Drill Bucket assembly is attached to the lowermost position of a Kelly bar, a conventional part of the drilling rig, and suspended to perform the drilling operation. When the bucket is rotated the soil excavated by a unique drill head is moved into the drill bucket. The drill bucket filled with the excavated soil is then raised by the drilling rig and the soil in the bucket is removed when an actuator member comes in contact with the rotating sombrero, a conventional part of the drilling rig, and the drill bucket is either raised above the drill head or the drill head pushed down from the drill bucket. Several methods can be used to accomplish this similar process, some being a scissor action mechanical method, a hydraulic actuated method, a direct downward pressure method and a method where a latch is actuated by a rod coming against the sombrero to release the drill head to translate down a shaft to remove the material, by the means of rapidly spinning the device.

Numerous innovations for drills used for drilling foundation piles have been provided in the prior art that are described as follows. Even though these innovations may be suitable for the specific individual purposes to which, they address, they differ from the present design as hereinafter contrasted. The following is a summary of those prior art patents most relevant to this application at hand, as well as a description outlining the difference between the features of the Axially Separating Drill Bucket and the prior art.

U.S. Pat. No. 5,234,062 of Hachiro Inoue describes an automatic evacuation drilling bucket comprises a follower formed with a working space for receiving a blade member which is capable of coming in contact with an osculating arm, the working space having upper, lower, transition and receiving compartments. If the blade member is located in the upper and lower compartments, the blade member is engaged with the follower when a drive shaft member is rotated in the normal and reverse directions. If the blade member is urged to move into the receiving compartment through the transition compartment, the blade member comes in contact with the osculating arm when the drive shaft member is rotated in the reverse direction.

This patent describes an automatic evacuation drilling bucket that operates with a fixed drill bucket that has a hinged member at the bottom for the removal of the excavated material. If the material sticks to the side of the drill bucket it must be jarred to remove it and that often damages the equipment involved. It does not have the capability of digging the hole, cleaning the hole out, moving the material to the surface, separating the drill bucket from the drill head and pushing the material out in one operation.

U.S. Pat. No. 4,971,163 of Akira Ohashi et al describes a drilling bucket apparatus for expanding a bore-hole bottom for a cast-in-place pile. Drill bits are pivotally suspended from the upper portion of a drill pipe, which is a main frame of the apparatus, and are expanded and retracted radially by means of hydraulic cylinders. A bucket is attached to the lower end of the drill pipe and scrapers are installed on the side of the bucket. The scrapers are arranged to open and close sideward, following the movement of the drill bits. During drilling work, the apparatus is suspended from a Kelly bar of a drilling machine. When the apparatus is rotated and the drill bits are expanded, the whole expanded shape of a bore-hole bottom is drilled simultaneously and cuttings are scraped into the bucket by means of the drill bits and the scrapers. Further, a bottom lid of the bucket can be released by operating a hydraulically-actuated opening lever, whereby, cuttings are discharged automatically.

This patent describes a drilling bucket apparatus for expanding a bore-hole bottom for a cast-in-place pile. It does not have the capability of digging the hole, cleaning the hole out, moving the material to the surface, separating the drill bucket from the drill head and pushing the material out in one operation.

U.S. Pat. No. 4,604,818 of Hachiro Inoue describes an under reaming pile bore excavating bucket and the method of excavating an under reamed part of a pile bore, and more particularly to an excavating bucket such that an under reamed part of a pile bore can be excavated and further the excavated soil can be moved into the bucket body for easy removal of soil. The bucket includes, in particular, a plurality of slidable wing bits housed within a bucket and moved downward and extended outward along guide rails at the bottom, of an already excavated straight pile bore.

This patent describes an under reaming pile bore excavating bucket and the method of excavating an under reamed part of a pile bore. The bucket, includes, in particular, a plurality of slidable wing bits housed within, a bucket and moved downward and extended outward along guide rails at the bottom of an already excavated straight pile bore. It does not have the capability of digging the hole, cleaning the hole out, moving the material to the surface, separating the drill bucket from the drill head and pushing the material out in one operation.

U.S. Pat. No. 2,126,124 of Frank S. McCutcheon describes an excavating bucket that may be used for circular shafts and wells, and that may be completely operated and controlled with only one cable. A further object of this invention is to provide an excavating bucket to be used in confined quarters where the space of operation is limited. Still further objects of this invention are to provide an excavating bucket that is positive in its action, which conforms to the shape of the excavation, that allows water to run from the excavated material in the bucket and that has few moving parts. A still further object of this invention is to provide an excavating bucket that is economical in manufacture, durable and efficient in use.

This patent describes an excavating bucket that may be used for circular shafts and wells. It does not have the capability of digging the hole, cleaning the hole out, moving the material to the surface, separating the drill bucket from the drill head and pushing the material out in one operation.

US pending Patent Application Publication No. US 2004/0168831 A1 of Satoshi Nozaki et al. describes locking elements that are provided at an inner member connected to a Kelly bar, and a locking element bearing plate provided at an outer member. The outer member includes a cylindrical bucket and a grab bucket housed inside the cylindrical bucket. When an excavating tool is in its most contracted state, the inner member is rotated forward to lock the locking elements at the locking element bearing plate, thereby disallowing relative vertical movement of the inner member and the outer member. As the excavating tool is rotated by applying a force to the Kelly bar along the lifting direction in this state, an excavating operation can be executed while applying a load smaller than the load of the excavating tool. As a result, it becomes possible to execute an excavating operation with a large excavating tool in conjunction with an earth drill having a small drive force. Projections provided at the outer circumference of the inner member are fitted at guide rails extending along the longitudinal direction and provided at the inner circumference of the second member so as to be allowed to move up/down freely. Thus, the grab bucket having an underground obstacle grabbed therein can be rotated to remove the underground obstacle.

This patent describes a device where the outer member includes a cylindrical bucket and a grab bucket housed inside the cylindrical bucket. When an excavating tool is in its most contracted state, the inner member is rotated forward to lock the locking elements at the locking element bearing plate, thereby disallowing relative vertical movement of the inner member and the outer member. It does not have the capability of digging the hole, cleaning the hole out, moving the material to the surface, separating the drill bucket from the drill head and pushing the material out in one operation.

None of these previous efforts, however, provides the benefits attendant with the Axially Separating Drill Bucket. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of this application in detail it is to be understood that the design is not limited in its application to the details of construction and to the arrangement of the components set forth in the following description or illustrated in the drawings. The Axially Separating Drill Bucket is capable of other embodiments and of being practiced and carried out in various ways, in addition, it is to be understood that the phraseology and terminology employed herein are for the purpose of description and should not be regarded as limiting.

SUMMARY OF THE INVENTION

The principal advantage of the Axially Separating Drill Bucket is that it eliminates the stress and shock loads incurred on the machinery's hydraulic equipment when attempting to remove material from existing drill buckets.

Another advantage of the Axially Separating Drill Bucket is that it both drills the hole and removes the material in a single operation.

Another advantage of the Axially Separating Drill Bucket is that in different designs the side wall casing can be raised above the drill head or the drill head can be lowered below the side wall casing to remove the excavated material.

Another advantage of the Axially Separating Drill Bucket is that the drill head has the capability to be rotated in one direction to drill the hole with the material entering the drill bucket and rotating in the opposite direction to close off the opening to the internal cavity to retain the material to be lifted to the surface.

Another advantage of the Axially Separating Drill Bucket is that several methods can be used to either raise the bucket or lower the drill head.

Another advantage of the Axially Separating Drill Bucket is that when lifted above the ground an actuator member can come in contact with the sombrero of the drill rig to activate the release mechanism.

Another advantage of the Axially Separating Drill Bucket is the compacted soil/material does not rely on gravity to fall out of the bucket.

Another advantage of the Axially Separating Drill Bucket is the material can be pulled or pushed out and spread out evenly by the accelerated spinning motion.

Another advantage of the Axially Separating Drill Bucket is the material cannot stick in the bucket.

Yet another advantage of the Axially Separating Drill Bucket is if water is in the hole when drilling, there is an internal cavity to allow the water to pass through the Drill Bucket, thus keeping the water/fluid clean to prevent hydrolocking or caving.

Another advantage is the Axially Separating Drill Bucket replaces a hinged bottom bucket which can open in the hole and get mechanically stuck causing the doors to be broken off if and when the bucket can be freed and pulled out of the hole.

A further advantage is to provide an Axially Separating Drill Bucket assembly that reduces costly repairs, and eliminates the need for hinged bottoms.

And yet a further advantage is to provide a simple Axially Separating Drill Bucket device with fewer moving parts, reducing repairs and the cost of maintenance.

Another advantage is to provide an Axially Separating Drill Bucket that reduces shock and wear and tear on the winch, cables and drill rig compared to conventional drill buckets.

Another advantage is to provide an Axially Separating Drill Bucket facilitating improved production and cycle times as it is faster and easier to empty.

Another advantage is to provide an Axially Separating Drill Bucket facilitating improved safety as no man is required to be positioned by the hole to unlatch.

Another advantage is to provide an Axially Separating Drill Bucket which can be operated by a single operator significantly saving labor costs.

And yet another advantage is to provide an Axially Separating Drill Bucket having no zerk fittings to grease, no bushings to wear out, no door to rip off or get stuck, no hinges to wear out or break, no latches to adjust or wear out and no need for safety latches to trip by hand.

These together with other advantages of the Axially Separating Drill Bucket along with the various features of novelty, which characterize the design, are pointed out with particularity in the claims annexed to and forming a part of this disclosure. In this respect, before explaining at least one of the embodiments of the Axially Separating Drill Bucket in detail it is to be understood that the design is not limited in its application to the details of construction and to the composition set forth in the following description or illustrated in the drawings The Axially Separating Drill Bucket is controlled by the means of heavy equipment, commonly called the drill rig, with a drill rotary that rotatably turns a conventional Kelly bar attached to the device. A unit called the sombrero is a fixed pan of the drill rotary that the Kelly bar passes through extending to a drive box section of the Axially Separating Drill Bucket assembly. The Kelly bar attaches to the drive box section by a variety of connection means but most often by the means of a square section inserted in a square orifice with a locking retainer. The drive box section is permanently attached to the drill stem that can be either a round or square cross section and extends through the drill bucket to be connected to the drill head. The drill bucket consists of a heavy wailed steel tubular member open at one end and closed at the other by the means of a heavy steel cap plate welded in place. In the center of the cap plate on the preferred embodiment is an orifice where the drill stem passes through and the drill bucket translates up and down.

A long vertical key section is part of the drill stem that engages in a key slot in the steel cap plate keeping the drill bucket from rotating when the Axially Separating Drill Bucket assembly is turning. A pusher plate can be permanently attached to the drill stem in order to push or pull the material out of the drill bucket central cavity when the drill bucket is separated.

In the preferred embodiment the drill bucket will be raised by a single external scissor action mechanism on the outside of the drill bucket above the steel cap plate. The actuator member translates through an elongated slot of the drive box section to pivotally attach to the first scissor section that rotates about a pivot attached to the drill stem. At the distal end of the first scissor section is a pivoting link attached to a pivot lug fixed to the upper surface of the steel cap plate. A second similar external scissor action mechanism can be added on the other side of the drill stem to equalize the forces required to raise the drill bucket. When the Axially Separating Drill Bucket is raised above the surface the actuator member makes contact with the stationary sombrero exerting a downward force raising the drill bucket. The elongated slot in the drive box section keeps the mechanism from being clogged when in operation.

In the first alternate embodiment of the Axially Separating Drill Bucket where the drill bucket will be raised by a single internal scissor action mechanism within the drill bucket. In this process the actuator member translates through an elongated slot of the drive box section and an elongated slot in the steel cap plate to pivotally attach to the first scissor section that rotates about a pivot point on the drill stem. A the distal end of the first scissor section the second scissor section is pivotally attached with its distal end pivotally attached to a pivot lug fixed to the under surface of the steel cap plate. When the axially separating side wall casing is raised the actuator member makes contact with the stationary sombrero exerting a downward force raising the drill bucket. The elongated slots in both the drive box section and the steel cap plate keep the mechanism from being clogged when in operation. A second similar scissor action mechanism within the drill bucket can be added on the other side of the drill stem to equalize the forces required to raise the drill bucket.

The drill head consists of a drill head plate that is permanently attached to the distal end of the drill stem. There may be several drill bucket alignment features with the first, being a beveled edge to the drill bucket mating with a beveled edge on the drill head plate. Another alignment feature will be a number of alignment tabs welded around the circumference of the drill head plate with anti-rotation stop blocks attached to the inner surface of the side wall casing to resist any twisting between the drill bucket and the drill head plate. Another alignment feature will be an extension of intermittent side segments of the lower surface of the drill bucket mating with cutouts in the drill head plate. The drill tip plate has polarity of digging teeth and a central rod extending into a mating hole in the drill stem. A circumferential groove on the central rod aligns with a slot in the drill stem where a drill tip plate retainer allows the drill tip plate to rotate and be easily removed or changed if necessary.

In the digging operation the drill tip plate with cutting teeth pivots against a stop plate welded on the drill head plate so that when rotating the Axially Separating Drill Bucket the opening in the drill head plate is exposed with the material going into the drill bucket cavity. By reversing the rotation the drill tip plate is forced in the opposite direction against a second stop plate closing the opening in the drill head plate so that the device can be raised to the surface without releasing the excavated material. The limiting stops, on the bottom surface of the drill head plate, act to keep the drill tip plate from making a full rotation in either direction.

A steel angle bar vent can be welded to the length of the inner surface of the side wall casing with an orifice in the steel cap plate and the drill head plate creating a separate cavity where water that might accumulate at the bottom of the hole could travel up through the Axially Separating Drill Bucket. This is an option that can be incorporated into any of the embodiments of this application.

In the second alternate embodiment of the Axially Separating Drill Bucket assembly the process is to separate the drill bucket by the means of using a large capacity hydraulic cylinder attached to the drive box section with a actuator member extending up to make contact with the sombrero when the Axially Separating Drill Bucket is raised above the ground. This contact forces the hydraulic fluid into a smaller and longer hydraulic cylinder attached to a lug on the upper surface of the steel cap plate raising the side wall casing away from the drill head plate. Additionally, a second smaller and longer hydraulic cylinder connected to the same large capacity hydraulic cylinder, could be attached to a second lug on the other side of the drill stem on the upper surface of the steel cap plate to equalize the forces required to separate the side wall casing.

A third alternate embodiment of the Axially Separating Drill Bucket assembly will use the large capacity hydraulic cylinder with actuator member extending up to make contact with the sombrero when the Axially Separating Drill Bucket assembly is raised above the surface. This contact forces the hydraulic fluid into a second set of smaller and longer hydraulic cylinders attached to a lug on the under surface of the steel cap plate raising the drill bucket, away from the drill head plate.

A forth alternate embodiment of the Axially Separating Drill Bucket assembly will use the large capacity hydraulic cylinder attached to the drive box section that is permanently attached to the drill stem with the actuator member extending up to make contact with the sombrero when the Axially Separating Drill Bucket assembly is raised above the ground. The side wall casing will be welded permanently to the drill stem and hydraulic fluid forced into one or more smaller and longer hydraulic cylinders attached to a lug on the under surface of the steel cap plate. This action lowers the drill head plate by the means of a telescoping stem inner member that is an integral part of the drill head plate.

A fifth alternate embodiment of the Axially Separating Drill Bucket assembly will have the actuating rod spring loaded against the top surface of the side wall casing. The side wall casing and drill stem are welded together with a telescoping stem inner member part of the drill head plate. The actuating rod is welded to the steel drill head plate so that when it comes in contact with the sombrero on the surface the spring is compressed and the drill head plate is separated from the side wall casing.

The sixth alternate embodiment of the Axially Separating Drill Bucket assembly will have a spring loaded latching mechanism holding the drill head up against the side wall casing with an actuator member extending up through the steel cap plate. The drive box section is permanently attached to the steel cap plate with the Kelly bar held in place by the means of the locking retainer. When the Axially Separating Drill Bucket assembly is raised the actuator member makes contact with the sombrero releasing the telescoping drill stem extension to lower by the means of gravity until it hits the stop on the lower inner surface of the side wall casing.

The foregoing has outlined rather broadly the more pertinent and important features of the present Axially Separating Drill Bucket in order that the detailed description of the application that follows may be better understood so that the present contribution to the art may be more fully appreciated. Additional features of the design will be described hereinafter which form the subject of the claims of this disclosure. It should be appreciated by those skilled in the art that the conception and the disclosed specific embodiment may be readily utilized as a basis for modifying or designing other structures and methods for carrying out the same purposes of the present design. It should also be realized by those skilled in the art that such equivalent constructions and methods do not depart from the spirit and scope of this application as set forth in the appended claims.

BRIEF DESCRIPTION OF THE DRAWINGS

The accompanying drawings, which are incorporated in and form a part of this specification, illustrate embodiments of the Axially Separating Drill Bucket and together with the description, serve to explain the principles of this application.

For a fuller understanding of the nature and advantages of the Axially Separating Drill Bucket, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figure 1:
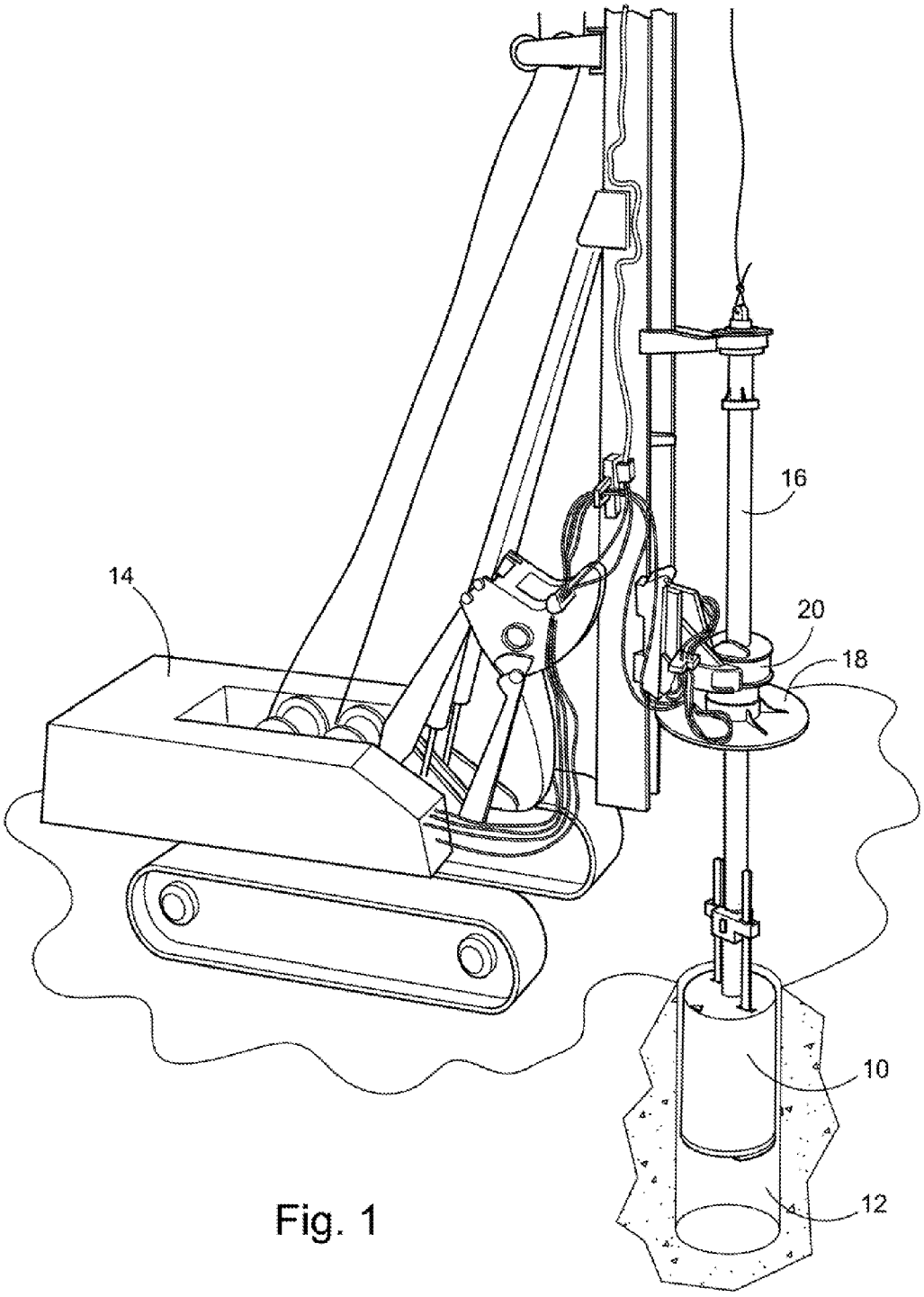
FIG. 1 depicts a perspective drawing of the Axially Separating Drill Bucket being lowered into a hole by the means of a drill rig.

Referring now to the drawings, wherein similar parts of the Axially Separating Drill Bucket 10 are identified by like reference numerals, there is seen in FIG. 1 a perspective drawing of the Axially Separating Drill Bucket 10 being lowered into a hole 12 by the means of a drill rig 14 with the Kelly bar 16 extending through the rotating sombrero 18 below the rotational drive mechanism 20.

Figure 2:
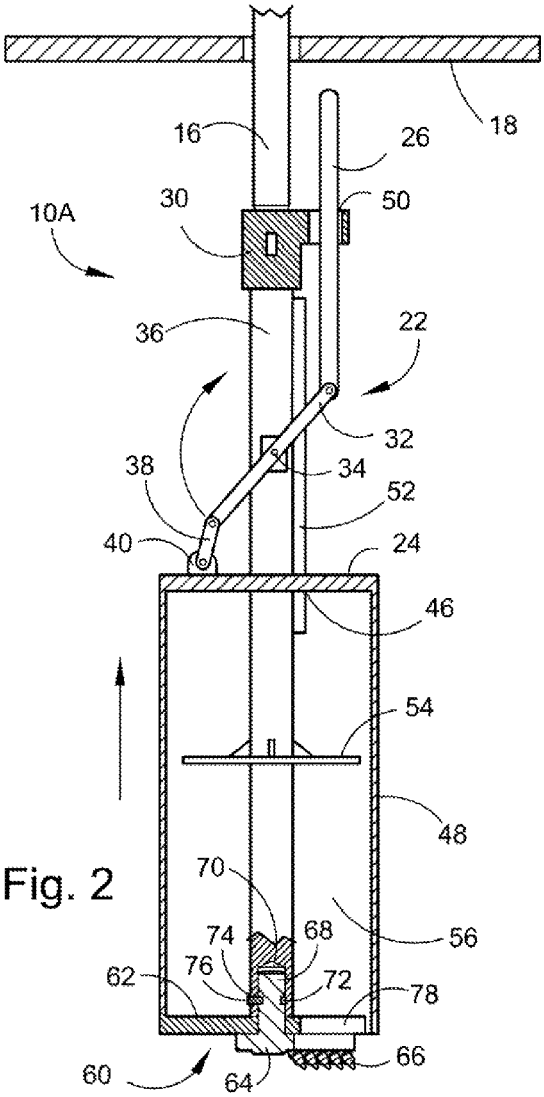
FIG. 2 depicts a cross sectional view of the preferred embodiment of the Axially Separating Drill Bucket with a single external scissor action movement having the drill head in upper position.

FIG. 2 depicts a cross sectional view of the preferred embodiment of the Axially Separating Drill Bucket 10A with a single external scissor action movement 22 on the outside of the drill bucket above the steel cap plate 24 where the actuator member 26 translates through an elongated slot 50 of the drive box section 30 to pivotally attach to the first scissor section 32 that rotates about a pivot 34 attached to the drill stem 36. At the distal end of the first scissor section 32 is a pivoting link 38 attached to a pivot lug 40 fixed to the upper surface of the steel cap plate 24. When the Axially Separating Drill Bucket 10A is raised above the surface the actuator member 26 makes contact with the stationary sombrero 18 exerting a downward force raising the side wall casing 48. The elongated slot 50 in the drive box section 30 keeps the mechanism from being clogged when in operation. A long vertical key 52 is part of the drill stem 36 that engages in a key slot 46 in the steel cap plate 24 securing the side wall casing 48 to the drill stem 36 when the Axially Separating Drill Bucket 10A is rotated. A pusher plate 54 can be permanently attached to the drill stem 36 in order to push the material out of the drill bucket central cavity 56 when side wall casing 48 is separated.

At the lower distal end of the drill stem 36 is the drill head assembly 60 consisting of a drill head plate 62 that is permanently attached to the distal end of the drill stem 36. A drill tip plate 64 located below the drill head plate 62 has polarity of digging teeth 66 and a central rod 68 extending into a mating hole 70 in the drill stem 36. A circumferential groove 72 in the central rod 68 aligns with a slot 74 in the drill stem 36 where a drill tip plate retainer 76 allows the drill tip plate 64 to rotate and be easily removed if necessary. An opening 78 ahead of the digging teeth 66 of the drill tip plate 64 allows the excavated material to enter the drill bucket central cavity 56.

Figure 3:
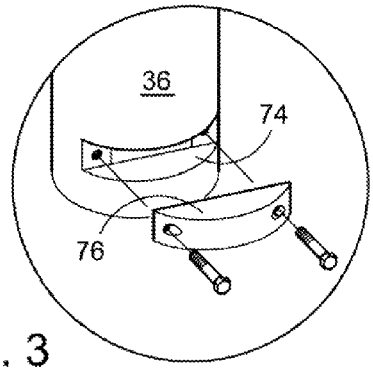
FIG. 3 depicts an exploded view of the retainer in the drill stem securing the drill tip plate into position.

FIG. 3 depicts an exploded view of the drill tip plate retainer 76 in the drill stem 36 securing the drill tip plate 64 into position.

Figure 4:
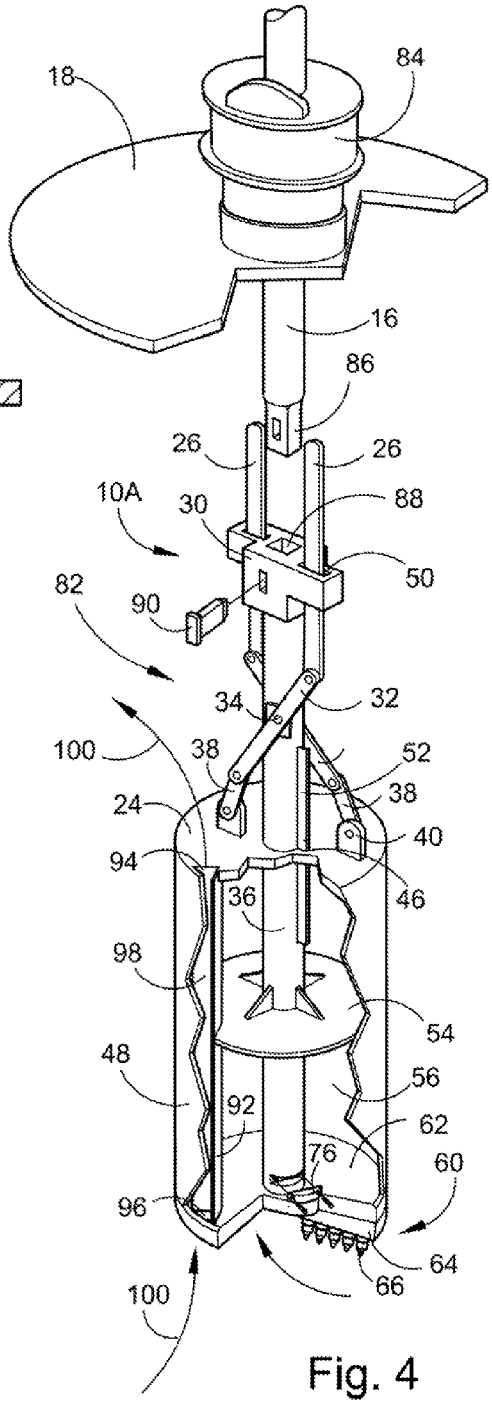
FIG. 4 depicts a perspective view of the preferred embodiment of the Axially Separating Drill Bucket with a double external scissor action movement having the drill head in the closed position.

FIG. 4 depicts a perspective view of the preferred embodiment of the Axially Separating Drill Bucket 10A with a second external scissor action movement 82 having the drill head assembly 60 in upper position. The rotational drive mechanism 84 is located above the sombrero 18 with the Kelly bar 16 having a square distal end 86 that will mate with the square orifice 88 in the drive box section 30 using the locking pin 90 to secure it in place. A steel angle bar 92 welded to the length of the inner surface of the side wall casing 48 with an upper orifice 94 in the steel cap plate 24 and a lower orifice 96 in the drill head plate 62 creates a separate water vent/channel 98 where water 100 can travel up through the Axially Separating Drill Bucket 10A assembly during the drilling operation. This is an option that can be incorporated into any of the embodiments of this application.

Figure 5:
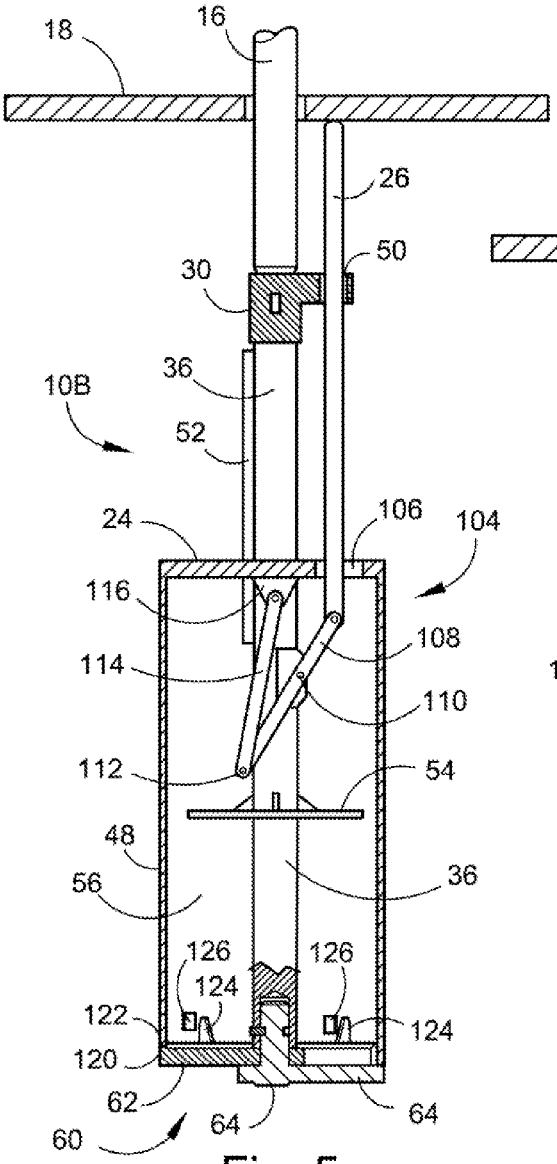
FIG. 5 depicts a cross sectional view of the first alternate embodiment of the Axially Separating Drill Bucket with a single internal scissor action movement having the drill head in the closed position.

FIG. 5 depicts a cross sectional view of the first alternate embodiment of the Axially Separating Drill Bucket 10B where the side wall casing 48 will be separated by a single internal scissor action mechanism 104 within the side wall casing 48. In this action an actuator member 26 translates through an elongated slot 50 of the drive box section 30 and an elongated slot 106 in the steel cap plate 24 to pivotally attach to the first scissor section 108 that rotates about a pivot 110 attached to the drill stem 36. At the distal end 112 of the first scissor section 108 the second scissor section 114 is pivotally attached with its distal end pivotally attached to a pivot lug 116 fixed to the under surface of the steel cap plate 24. When the Axially Separating Drill Bucket 10B is raised the actuator member 26 makes contact with the stationary sombrero 18 exerting a downward force raising the side wall casing 48. The elongated slots 50 and 106 in both the drive box section 30 and the steel cap plate 24 keep the mechanism from being clogged when in operation. There may be several side wall casing 48 alignment features with the first, being a beveled edge 122 to the side wall casing 48 mating with flat edge 120 on the drill head plate 62. Another alignment feature will be a number of alignment tabs 124 welded around the circumference of the drill head plate 62 with anti-rotation stop blocks 126 attached to the inner surface of the side wall casing 48 to resist any twisting between the side wall casing 48 and the drill head plate 62.

Figure 6:
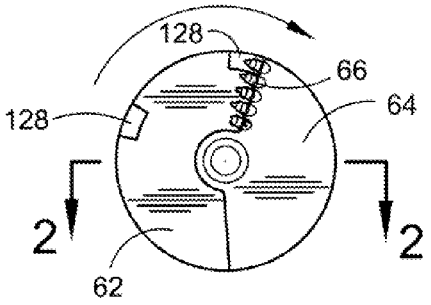
FIG. 6 depicts a bottom view of the Axially Separating Drill Bucket with the drill tip plate rotated closing the opening in the drill head plate.

FIG. 6 depicts a bottom view of the Axially Separating Drill Bucket 10B with the drill tip plate 64 rotated closing the opening 78 (shown open in FIG. 8) in the drill head plate 62. The two rotational stops 128 are welded to the bottom surface of the drill head plate 62.

Figure 7:
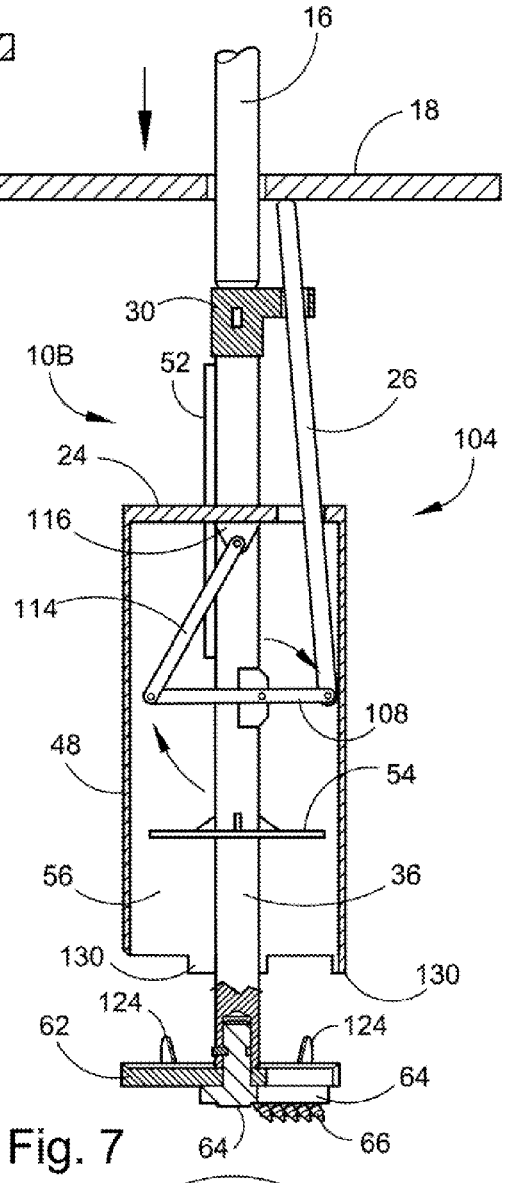
FIG. 7 depicts a cross sectional view of the first alternate embodiment of the Axially Separating Drill Bucket with the single internal scissor action movement having the drill head in the partially separated position.

FIG. 7 depicts a cross sectional view of the first alternate embodiment of the Axially Separating Drill Bucket 10B with the single internal scissor action movement 104 having the drill head assembly 60 (not shown in FIG. 7) in the partially extended position. Another optional alignment feature illustrated will be an extension of intermittent side segments 130 of the lower surface of the side wall casing 48 mating with cutouts in the drill head plate 62.

Figure 8:
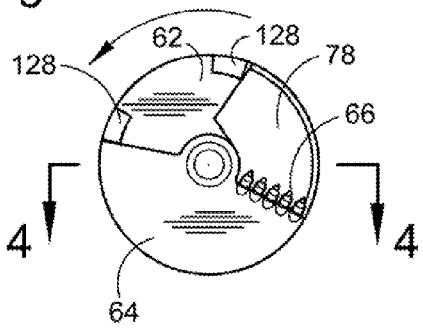
FIG. 8 depicts a bottom view of the Axially Separating Drill Bucket with the drill tip plate rotated exposing the opening in the drill head plate.

FIG. 8 depicts a bottom view of the Axially Separating Drill Bucket 10B with the drill tip plate 64 rotated exposing the opening 78 in the drill head plate 62 with the two rotational stops 128 welded to the bottom surface of the drill head plate 62.

Figure 9:
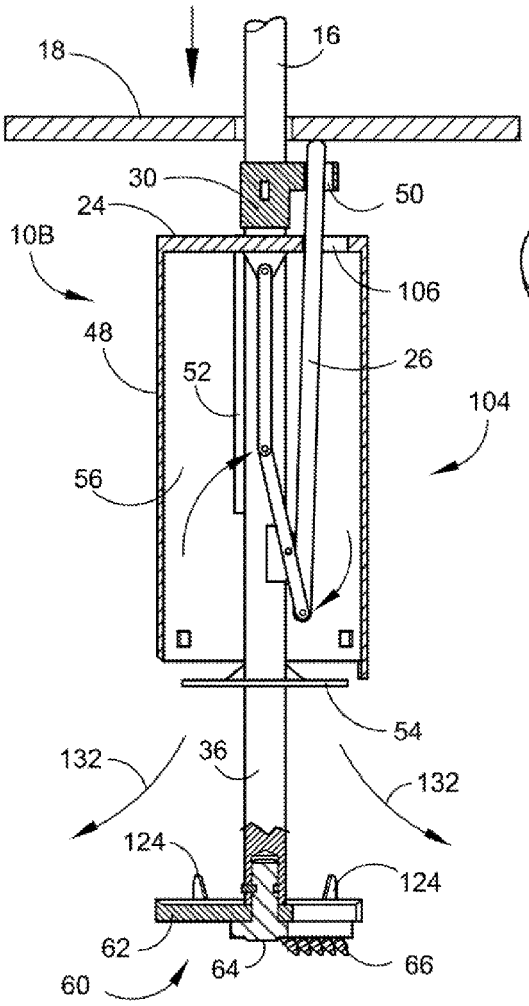
FIG. 9 depicts a cross sectional view of the first alternate embodiment of the Axially Separating Drill Bucket with the single internal scissor action movement having the drill head in the fully separated position.

FIG. 9 depicts a cross sectional view of the first alternate embodiment of the Axially Separating Drill Bucket 10B with the single internal scissor action movement 104 having the drill head assembly 60 in the fully separated position. The arrows 132 indicate the direction that the excavated material would be pushed out by the optional pusher plate 54.

Figure 10:
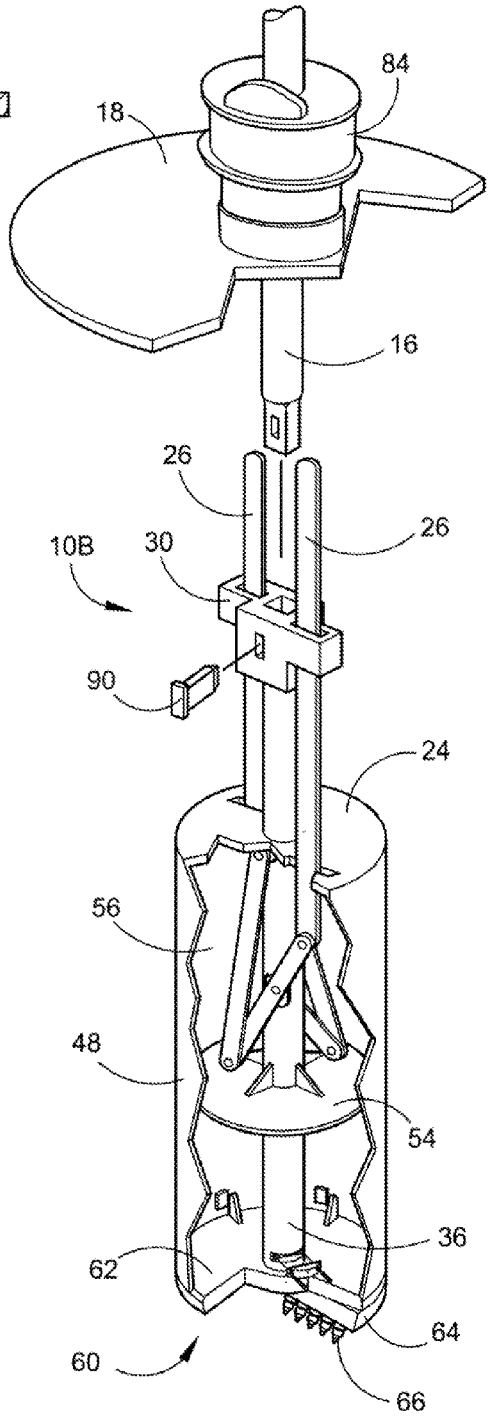
FIG. 10 depicts a perspective view of the first alternate embodiment of the Axially Separating Drill Bucket with a double internal scissor action movement having the drill head in closed position.

FIG. 10 depicts a perspective view of the first alternate embodiment of the Axially Separating Drill Bucket 10B with a second similar scissor action movement 104 within the side wall casing 48 that can be added on the other side of the drill stem 36 to equalize the forces required to raise the side wall casing 48.

Figure 11:
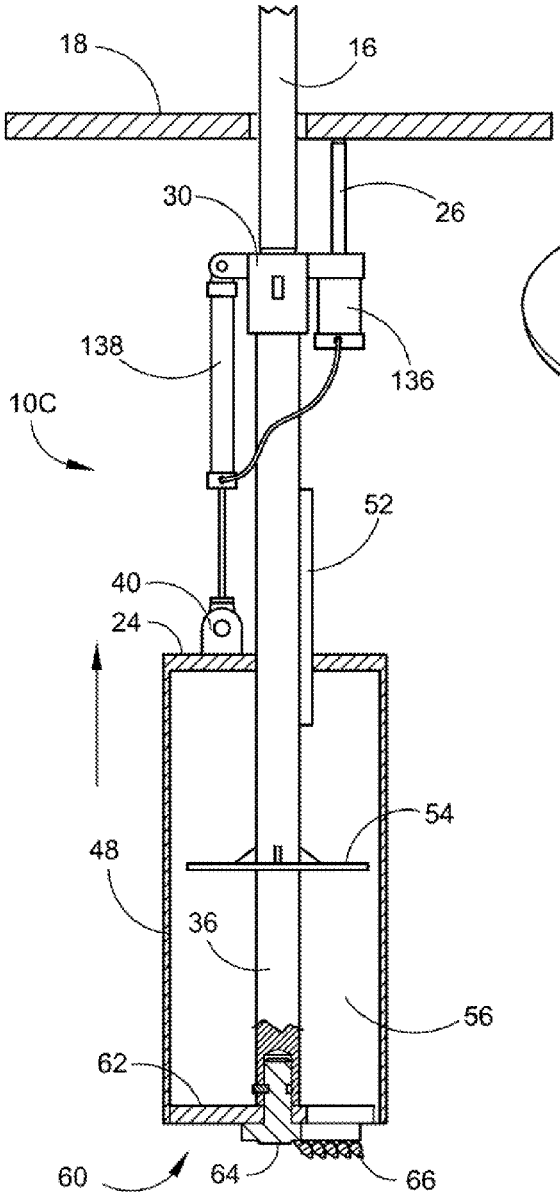
FIG. 11 depicts a cross sectional view of the second alternate embodiment of the Axially Separating Drill Bucket using a hydraulic method using a large capacity hydraulic cylinder connected to a smaller longer hydraulic cylinder to raise the side wall casing from the drill head.

FIG. 11 depicts a cross sectional view of the second alternate embodiment of the Axially Separating Drill Bucket 10C using a hydraulic method with a large capacity hydraulic cylinder 136 connected to a single smaller longer hydraulic cylinder 138 to separate the side wall casing 48 from the drill head assembly 60. The large capacity hydraulic cylinder 136 attached to the drive box section 30 with a actuator member 26 extending up to make contact with the sombrero 18 when the Axially Separating Drill Bucket 10C is raised above the ground. This contact forces the hydraulic fluid into a smaller and longer hydraulic cylinder 138 attached to a lug 40 on the upper surface of the steel cap plate 24 raising the side wall casing 48 away from the drill head assembly 60.

Figure 12:
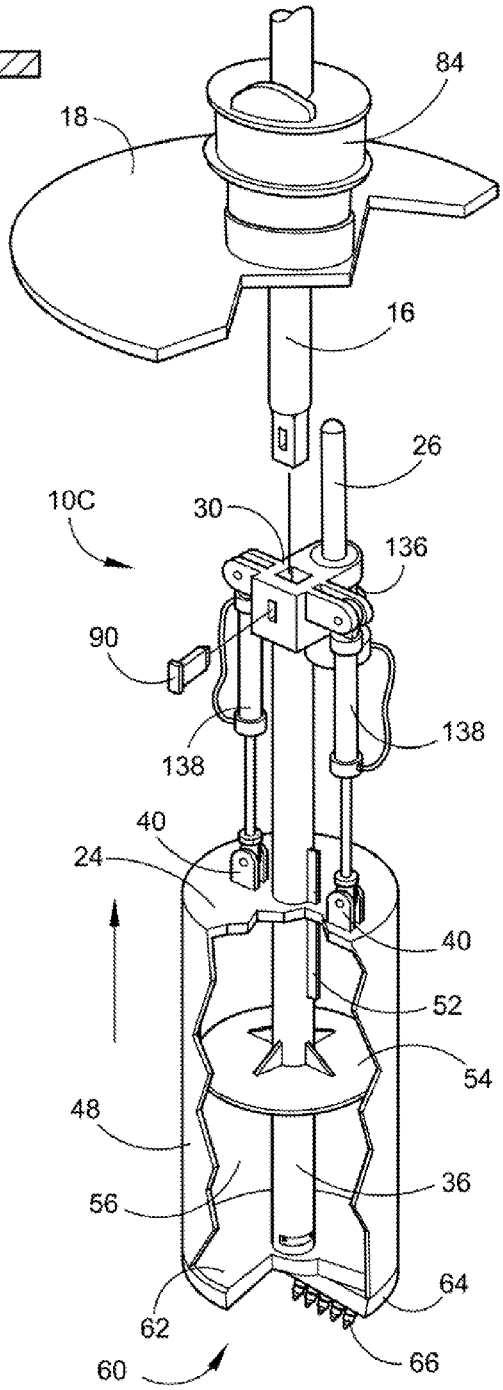
FIG. 12 depicts a perspective view of the second alternate embodiment of the Axially Separating Drill Bucket using a hydraulic method using a large capacity hydraulic cylinder connected to two smaller longer hydraulic cylinders to separate the side wall casing from the drill head.

FIG. 12 depicts a perspective view of the second alternate embodiment of the Axially Separating Drill Bucket 10C using a hydraulic method with a large capacity hydraulic cylinder 136 connected to two smaller longer hydraulic cylinders 138 to raise the side wall casing 48 from the drill head assembly 60 to equalize the forces required to separate the side wall casing 48.

Figure 13:
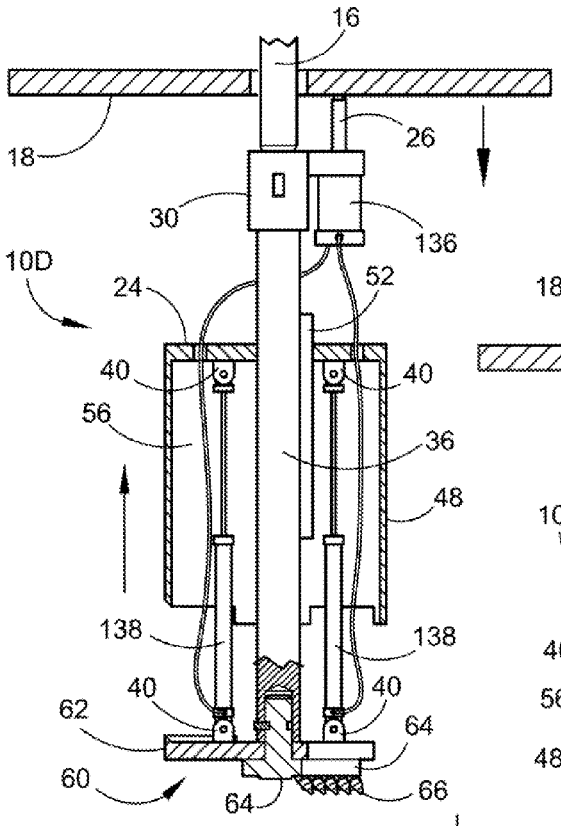
FIG. 13 depicts the third alternate embodiment of the Axially Separating Drill Bucket using a hydraulic method using a large capacity hydraulic cylinder connected to two smaller longer hydraulic cylinders to separate the side wall casing from the drill head.

FIG. 13 depicts cross sectional view of the third alternate embodiment of the Axially Separating Drill Bucket 10D using a hydraulic method with a large capacity hydraulic cylinder 136 connected to two smaller longer hydraulic cylinders 138 to raise the side wall casing 48 from the drill head assembly 60.

Figure 14:
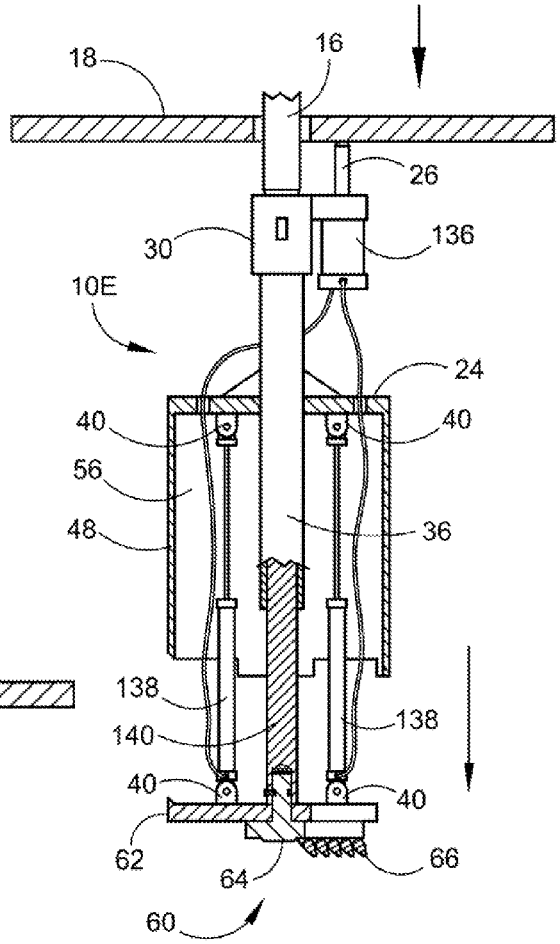
FIG. 14 depicts a cross sectional view of the forth alternate embodiment of the Axially Separating Drill Bucket having the side wall casing connected to the telescoping drill stem using a hydraulic method with a large hydraulic cylinder connected to two smaller longer hydraulic cylinders to lower the drill head using a telescoping drill stem.

FIG. 14 depicts a cross sectional view of the forth alternate embodiment of the Axially Separating Drill Bucket 10E having the side wall casing 48 permanently attached to the drill stem 36 using a hydraulic method with a large hydraulic cylinder 136 connected to two smaller longer hydraulic cylinders 138 to lower the drill head assembly 60 using a separating drill stem 140 attached to the drill head assembly 60.

Figure 15:
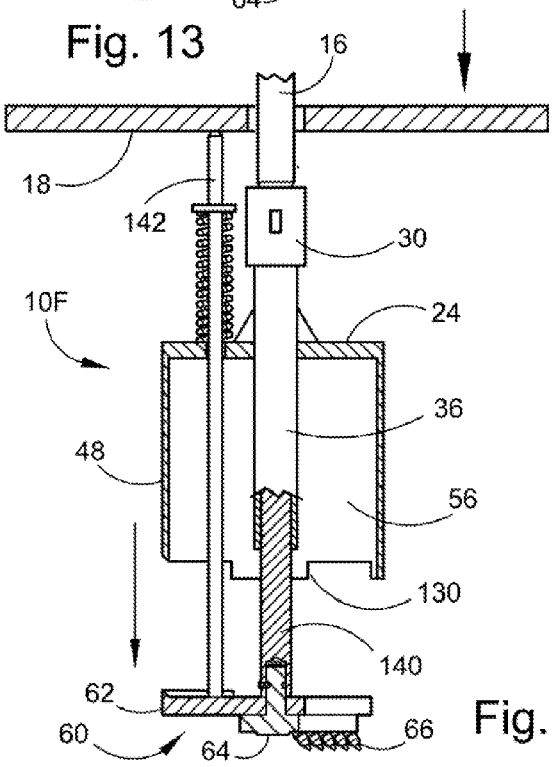
FIG. 15 depicts a cross sectional view of the fifth alternate embodiment of the Axially Separating Drill Bucket having the side wall casing connected to the separating drill stem and the spring loaded actuator member connected to the drill head. When the bucket is raised above ground and the actuator comes in contact with the sombrero and the drill head is separated from the side wall casing.

FIG. 15 depicts a cross sectional view of the fifth alternate embodiment of the Axially Separating Drill Bucket 10F having the side wall casing 48 connected to the separating drill stem 140 and the spring loaded actuator member 142 connected to the drill head assembly 60. When the Axially Separating Drill Bucket 10F is raised to the surface and the actuator comes in contact with the sombrero 18 the drill head assembly 60 is pushed down.

Figure 16:
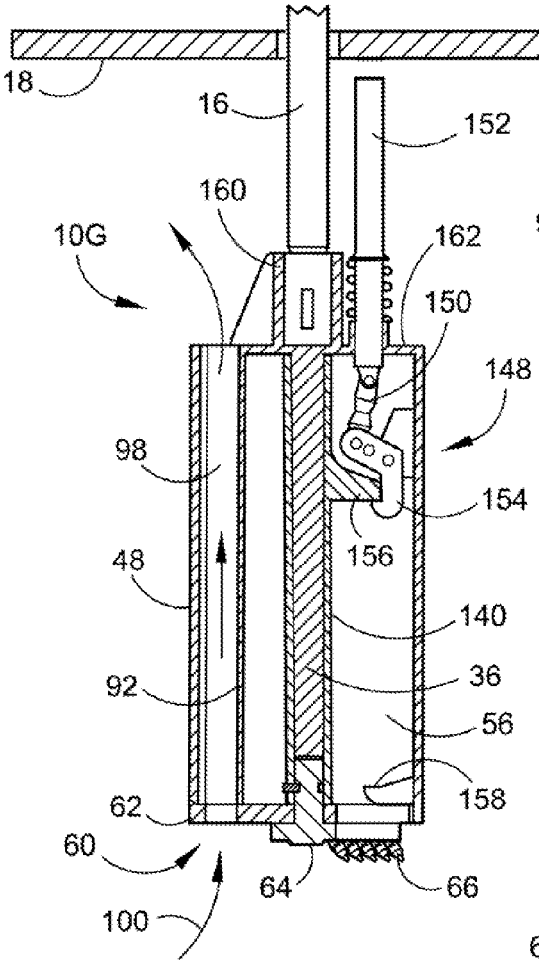
FIG. 16 depicts a cross sectional view of the sixth alternate embodiment of the Axially Separating Drill Bucket assembly having a spring loaded latching mechanism holding the drill head up against the side wall casing.

FIG. 16 depicts a cross sectional view of the sixth alternate embodiment of the Axially Separating Drill Bucket 10G having a spring loaded latching mechanism 148 holding the drill head assembly 60 up against the side wall casing 48. The spring loaded latching mechanism 148 operates by the means of the spring loaded actuator member 152 attached to the connector link 150 and the pivotal latch 154. The pivotal latch 154 is illustrated making contact with the latch catch 156 that is an integral part of the drill stem 36. A latch stop 158 is fixed to the lower rim of the side wall casing 48. In this embodiment the drive box section 160 is permanently attached to the steel cap plate 162.

Figure 17:
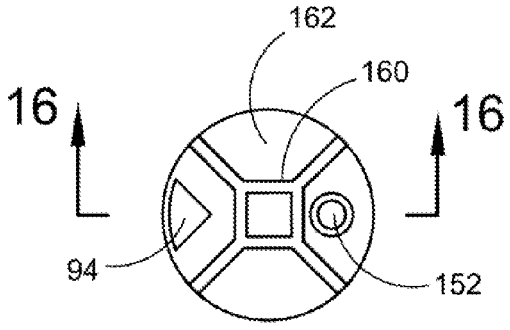
FIG. 17 depicts top view of the side wall casing.

FIG. 17 depicts top view of the Axially Separating Drill Bucket 10G where the drive box section 160 is permanently attached to the steel cap plate 162 exposing the upper orifice 94 of the water vent/channel 98 and the end of the spring loaded actuator member 152.

Figure 18:
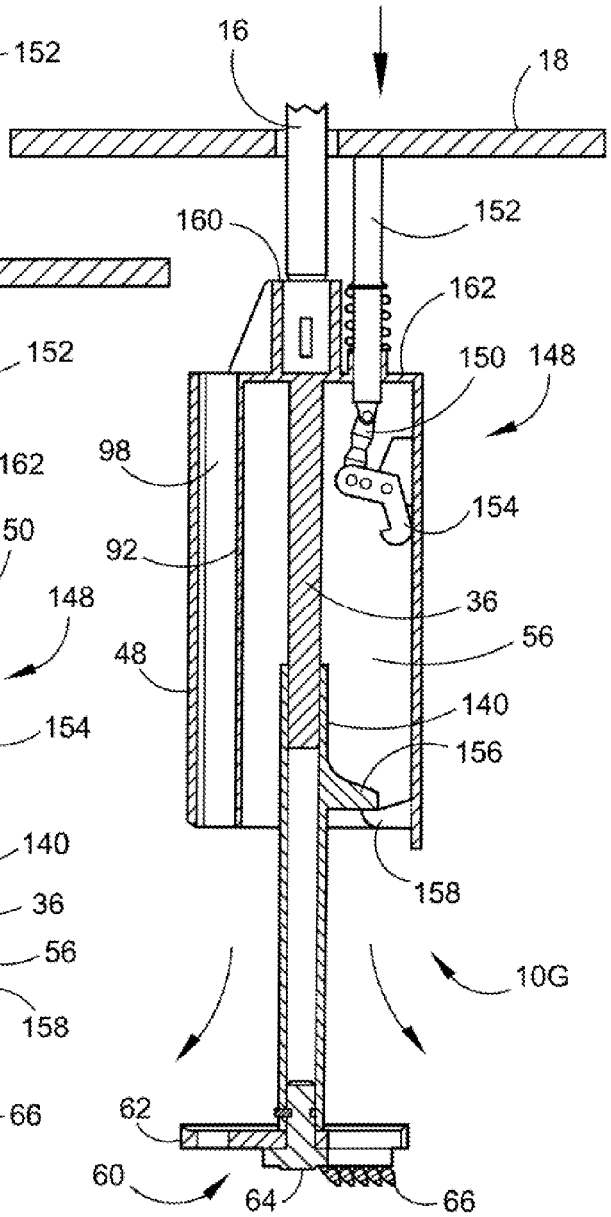
FIG. 18 depicts a cross sectional view of the sixth alternate embodiment of the Axially Separating Drill Bucket assembly having a spring loaded latching mechanism released with the drill head in the separated position.

FIG. 18 depicts a cross sectional view of the sixth alternate embodiment of the Axially Separating Drill Bucket 10G having a spring loaded latching mechanism 148 released with the drill head assembly 60 in the separated position.

Figure 19:
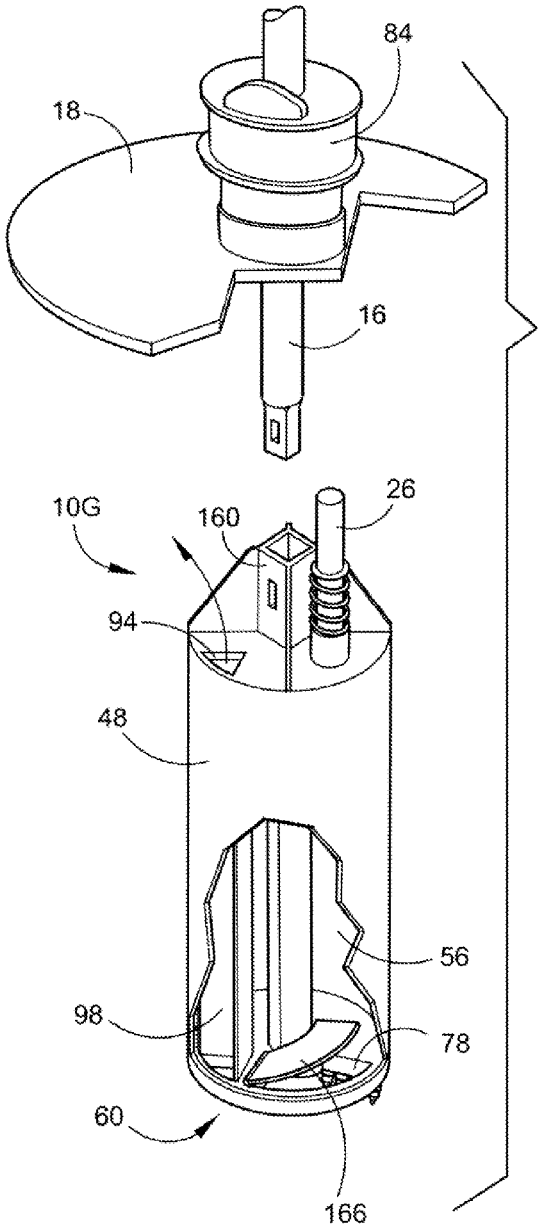
FIG. 19 depicts a perspective view of the sixth alternate embodiment of the Axially Separating Drill Bucket assembly having a spring loaded latching mechanism holding the drill head up against the side wall casing incorporating a flapper door open over the opening in the drill head plate with the water vent/channel exposed.

FIG. 19 depicts a perspective view of the sixth alternate embodiment of the Axially Separating Drill Bucket 10G having a spring loaded latching mechanism 148 (not shown) holding the drill head assembly 60 up against the side wall casing 48 incorporating a flapper door 166 open over the opening 78 in the drill head plate 62 (see FIG. 20 below) with the water vent/channel 98 exposed.

Figure 20:
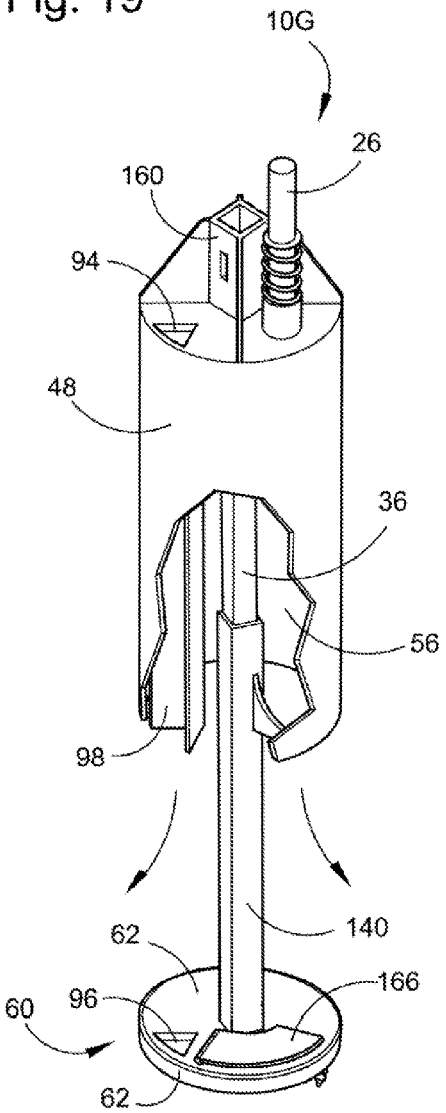
FIG. 20 depicts a perspective view of the sixth alternate embodiment of the Axially Separating Drill Bucket assembly having a spring loaded latching mechanism released and the drill head in the separated position incorporating a flapper closed over the opening in the drill head plate with the water vent/channel exposed.

FIG. 20 depicts a perspective view of the sixth alternate embodiment of the Axially Separating Drill Bucket 10G having a spring loaded latching mechanism 148 (not shown) released and the drill head assembly 60 in the separated position incorporating a flapper door 166 closed over the opening 78 (not shown) in the drill head plate 62 with the water vent/channel 98 exposed.

The Axially Separating Drill Bucket 10, 10A, 10B, 10C, 10D, 10E, 10F and 10G shown in the drawings and described in detail herein disclose arrangements of elements of particular construction and configuration for illustrating preferred and alternate embodiments of structure and method of operation of the present application. It is to be understood, however, that elements of different construction and configuration and other arrangements thereof, other than those illustrated and described may be employed for providing an Axially Separating Drill Bucket 10, 10A, 10B, 10C, 10D, 10E, 10F and 10G in accordance with the spirit of this disclosure, and such changes, alternations and modifications as would occur to those skilled in the art are considered to be within the scope of this design as broadly defined in the appended claims of this application.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured, by the claims, nor is it intended to be limiting as to the scope of the invention in any way.

I claim:

1. An axially separating drill bucket comprising:

a) a drive section removably attached to a drill rig rotational drive mechanism;

b) a drill stem including a removable drill head assembly;

c) a casing moveably attached to said drill stem; and d) an activatable separation mechanism including an actuation member attached to said casing wherein said activatable separation mechanism is activated by an external force resulting from said actuation member making contact with said drill rig;

whereby when said activatable separation mechanism is activated said casing separates from said drill head assembly.

2. The axially separating drill bucket according to claim 1, wherein said drill rig includes a sombrero, and further wherein said activatable separation mechanism is activated by an external force resulting from an actuation member making contact with said sombrero, thereby separating said casing from said drill head assembly.

3. The axially separating drill bucket according to claim 1, wherein said activatable separation actuation mechanism is actuated by hydraulic means.

4. The axially separating drill bucket according: to claim 3, wherein said activatable separation actuation mechanism actuated by hydraulic means includes one or more hydraulic cylinders.

5. The axially separating drill bucket according to claim 4, wherein said one or more hydraulic cylinders are located exterior to said side wall casing.

6. The axially separating drill bucket according to claim 4, wherein said one or more hydraulic cylinders are located interior to said side wall casing.

7. The axially separating drill bucket according to claim 4, wherein said one or more hydraulic cylinders are located both exterior and interior to said side wall casing.

8. The axially separating drill bucket according to claim 1, wherein said activatable separation actuation mechanism is actuated by mechanical means and said mechanical means is configured in a single scissor action movement thereby separating said side wall casing from said drill head assembly.

9. The axially separating drill bucket according to claim 1, wherein said activatable separation actuation mechanism is actuated by mechanical means and said mechanical means is configured in a double scissor action movement thereby separating said side wall casing from said drill head assembly.

10. The axially separating drill bucket according to claim 1, wherein said activatable separation mechanism includes a latch and is actuated by said drill rig when said latch is released thereby separating said casing from said drill head assembly.

11. The axially separating drill bucket according to claim 10, wherein said activatable separation mechanism including said latch further includes a spring loaded latching mechanism.

12. The axially separating drill bucket according to claim 1, wherein said drill stem includes a pusher plate attached thereto.

13. A method for making an axially separating drill bucket comprising the steps of:

a) providing a drive section removably attached to a drill rig rotational drive mechanism;

b) providing a drill stem including a removable drill head assembly;

c) providing a casing moveably attached to said drill stem; and d) providing an activatable separation mechanism including an actuation member attached to said casing wherein said activatable separation mechanism is activated by an external force resulting from said actuation member making contact with said drill rig;

whereby when said activatable separation mechanism is activated said casing separates from said drill head assembly.

14. The method for making an axially separating drill bucket according to claim 13, wherein drill rig includes a sombrero, and further wherein said activatable separation mechanism is activated by an external force resulting from an actuation member making contact with said drill rig at said sombrero, thereby separating said casing from said drill head assembly.

15. The method for making an axially separating drill bucket according to claim 13, wherein said activatable separation actuation mechanism is actuated by hydraulic means.

16. The method for making an axially separating drill bucket according to claim 15, wherein said activatable separation actuation mechanism actuated by hydraulic means includes one or more hydraulic cylinders.

17. The method for making an axially separating drill bucket according to claim 16, wherein said one or more hydraulic cylinders are located exterior to said side wail casing.

18. The method for making an axially separating drill bucket according to claim 16, wherein said one or more hydraulic cylinders are located interior to said side wall casing.

19. The method for making an axially separating drill bucket according to claim 16, wherein said one or more hydraulic cylinders are located both exterior and interior to said side wall casing.

20. The method for making an axially separating drill bucket according to claim 13, wherein said activatable separation actuation mechanism is actuated by mechanical means and said mechanical means is configured in a single scissor action movement thereby separating said side wall casing from said drill head assembly.

21. The method for making an axially separating drill bucket according to claim 13, wherein said activatable separation actuation mechanism is actuated by mechanical means and said mechanical means is configured in a double scissor action movement thereby separating said side wall easing from said drill head assembly.

22. The method for making an axially separating drill bucket according to claim 13, wherein activatable separation mechanism includes a latch and is actuated by gravity when said latch is released thereby separating said casing from said drill head assembly.

23. The axially separating drill bucket according to claim 13, wherein said drill stem includes a pusher plate attached thereto.

24. The method for making an axially separating drill bucket according to claim 22, wherein said activatable separation mechanism including said latch further includes a spring loaded latching mechanism.

* * * * *